US005528864A

United States Patent [19]

Jennings

[11] Patent Number: 5,528,864

[45] Date of Patent: Jun. 25, 1996

[54] FIREPLACE WEATHER STRIPPING FOR USE ON FIREPLACE DOORS

[76] Inventor: Thomas E. Jennings, 517 East Ave., J-12, Lancaster, Calif. 93535

[21] Appl. No.: 419,250

[22] Filed: Apr. 10, 1995

[51] Int. Cl.[6] ..... E06B 7/16

[52] U.S. Cl. ..... 49/490.1; 49/475.1

[58] Field of Search ..... 49/475.1, 490.1

[56] References Cited

U.S. PATENT DOCUMENTS

| | | | |
|---|---|---|---|
| 1,226,159 | 5/1917 | Aumand | 49/490.1 X |
| 2,711,789 | 6/1955 | Boyle et al. | 49/490.1 X |
| 2,766,494 | 10/1956 | Stremmel | 49/490.1 X |
| 4,220,681 | 9/1980 | Narita | 49/490.1 X |
| 5,032,444 | 7/1991 | Desir | 49/490.1 X |
| 5,264,270 | 11/1993 | Agrawal | 49/490.1 X |

FOREIGN PATENT DOCUMENTS

| | | | |
|---|---|---|---|
| 360997 | 4/1990 | European Pat. Off. | 49/490.1 |

*Primary Examiner*—Jerry Redman

[57] ABSTRACT

A fireplace weather strip for use on a fireplace door including an elongated flexible strip, the strip having an upper section, a lower section, and a central section therebetween, the central section including a body having a central axis disposed therethrough, a generally rectangular cross section formed of a horizontal planar upper surface, a horizontal planar lower surface, and a periphery interconnecting the upper and lower surfaces further formed of a front edge, a rear edge, a pair of opposed side edges, the upper section including an arm having a generally triangular cross-section formed of an upper edge positioned above the body, a front planar surface extended angularly upwards to the upper edge from the upper surface of the body, and a rear planar surface extended angularly upwards to the upper edge, the lower section including a front leg and a rear leg extended downwards from the lower surface of the body to define a holding space therebetween, and with an edge of a fireplace door removably securable within the holding space.

1 Claim, 3 Drawing Sheets

FIREPLACE WEATHER STRIPPING FOR USE ON FIREPLACE DOORS

BACKGROUND OF THE INVENTION

1. Field of the Invention

The present invention relates to fireplace weather stripping and more particularly pertains to preventing warm air inside a room from escaping up a chimney with fireplace weather stripping for use on fireplace doors.

2. Description of the Prior Art

The use of weather stripping or molding is known in the prior art. More specifically, weather stripping or molding heretofore devised and utilized for the purpose of precluding transfer of heat from a warm area to a cool area are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 300,464 to Davidson discloses weather stripping for doors and the like. U.S. Pat. Des. No. 300,465 to Nicholas discloses decorative molding for retainer flanges. U.S. Pat. No. 3,457,907 to Brunig discloses glass fireplace screen having improved draft control. U.S. Pat. No. 4,157,634 to Coulston discloses weather stripping. U.S. Pat. No. 4,490,943 to McLaughlin discloses weather stripping for doors. U.S. Pat. No. 4,970,829 to Brautigam discloses weather stripping.

While these devices fulfill their respective, particular objective and requirements, the aforementioned patents do not describe fireplace weather stripping that is easily secured to fireplace doors and prevents warm air within a building or home from traveling up a chimney of an associated fireplace.

In this respect, the fireplace weather stripping for use on fireplace doors according to the present invention substantially departs from the conventional concepts and designs of the prior art, and in doing so provides an apparatus primarily developed for the purpose of preventing warm air inside a room from escaping up a chimney to which the fireplace is connected.

Therefore, it can be appreciated that there exists a continuing need for new and improved fireplace weather stripping for use on fireplace doors which can be used for preventing warm air inside a room from escaping up a chimney to which the fireplace is connected. In this regard, the present invention substantially fulfills this need.

SUMMARY OF THE INVENTION

In the view of the foregoing disadvantages inherent in the known types of weather stripping or molding now present in the prior art, the present invention provides an improved fireplace weather stripping for use on fireplace doors. As such, the general purpose of the present invention, which will be described subsequently in greater detail, is to provide a new and improved fireplace weather stripping for use on fireplace doors and method which has all the advantages of the prior art and none of the disadvantages.

To attain this, the present invention essentially comprises, in combination, an elongated straight flexible strip formed of a generally resilient steel material coated with a layer of heat resistant plastic. The strip includes an upper section, a lower section, and a central section therebetween. The central section includes a body having a central axis disposed therethrough, a generally rectangular cross section formed of a horizontal planar upper surface, a horizontal planar lower surface, and a periphery interconnecting the upper and lower surfaces further formed of a front edge, a rear edge, a pair of opposed side edges. The central section further has a characteristic thickness as defined between the upper and the lower surfaces thereof.

The upper section includes an arm having a generally triangular cross-section formed of an upper edge positioned above the body and aligned in a common vertical plane with the central axis thereof, a front planar surface extended angularly upwards to the upper edge from the upper surface of the body at a location adjacent to the outboard edge thereof, and a rear planar surface extended angularly upwards to the upper edge from the upper surface of the body at a location offset from the front edge by a distance equal to the characteristic thickness. The upper surface of the body and the rear surface create an angle of between about 40 to 60 degrees therebetween. The upper section has a characteristic height equal to three times the characteristic width as defined between the top surface of the body and a parallel plane containing the upper edge.

The lower section includes a generally rectangular front leg of a characteristic thickness integral with and extended angularly downwards from the lower surface of the body, a generally rectangular rear leg of a characteristic thickness integral with extended angularly downwards from the lower surface of the body, and a holding space with an inverted trapezoidal cross section therebetween. The holding space is symmetrically aligned with respect to the central axis and has a sealed upper extent with a horizontal width that is about two times the characteristic thickness and a lower opening with a horizontal width that is essentially equal to the characteristic thickness. The front and rear legs each have a planar inboard surface, a planar outboard surface, and a horizontal planar lower edge interconnecting the inboard and outboard surfaces. A pair of equally-sized angles of between about 4 to 5 degrees is defined between the lower surface of the body and the opposed inboard surfaces of the legs. The lower section has a characteristic height essentially equal to six times the characteristic thickness as defined between the lower surface of the body and a common plane containing the lower edges of the legs. An edge of a fireplace door is removably securable within the holding space with the front and rear legs on each side thereof applying a clamping force thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fireplace weather stripping for use on fireplace doors which has all the advantages of the prior art weather stripping or molding and none of the disadvantages.

It is another object of the present invention to provide a new and improved fireplace weather stripping for use on fireplace doors which may be easily and efficiently manufactured and marketed.

It is a further object of the present invention to provide a new and improved fireplace weather stripping for use on fireplace doors which is of durable and reliable construction.

An even further object of the present invention is to provide a new and improved fireplace weather stripping for use on fireplace doors which is susceptible of a low cost of manufacture with regard to both materials and labor, and which accordingly is then susceptible of low prices of sale to the consuming public, thereby making such a fireplace weather stripping for use on fireplace doors economically available to the buying public.

Still yet another object of the present invention is to provide a new and improved fireplace weather stripping for use on fireplace doors which provides in the apparatuses and methods of the prior art some of the advantages thereof, while simultaneously overcoming some of the disadvantages normally associated therewith.

Even still another object of the present invention is to provide a new and improved fireplace weather stripping for use on fireplace doors for preventing warm air inside a room from escaping up a chimney to which the fireplace is connected.

Lastly, it is an object of the present invention to provide a new and improved fireplace weather stripping for use on fireplace doors comprising an elongated flexible strip, the strip including an upper section, a lower section, and a central section therebetween, the central section including a body having a central axis disposed therethrough, a generally rectangular cross section formed of a horizontal planar upper surface, a horizontal planar lower surface, and a periphery interconnecting the upper and lower surfaces further formed of a front edge, a rear edge, a pair of opposed side edges, the upper section including an arm having a generally triangular cross-section formed of an upper edge positioned above the body, a front planar surface extended angularly upwards to the upper edge from the upper surface of the body, and a rear planar surface extended angularly upwards to the upper edge from the upper surface of the body, the lower section including a front leg and a rear leg extended downwards from the lower surface of the body to define a holding space therebetween, the front and rear legs each having a planar inboard surface, and with an edge of a fireplace door removably securable within the holding space with the front and rear legs on each side thereof applying a clamping force thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof, Such description makes reference to the annexed drawings wherein.

The same reference numerals refer to the same parts through the various Figures.

DESCRIPTION OF THE PREFERRED EMBODIMENT

Figure 1:
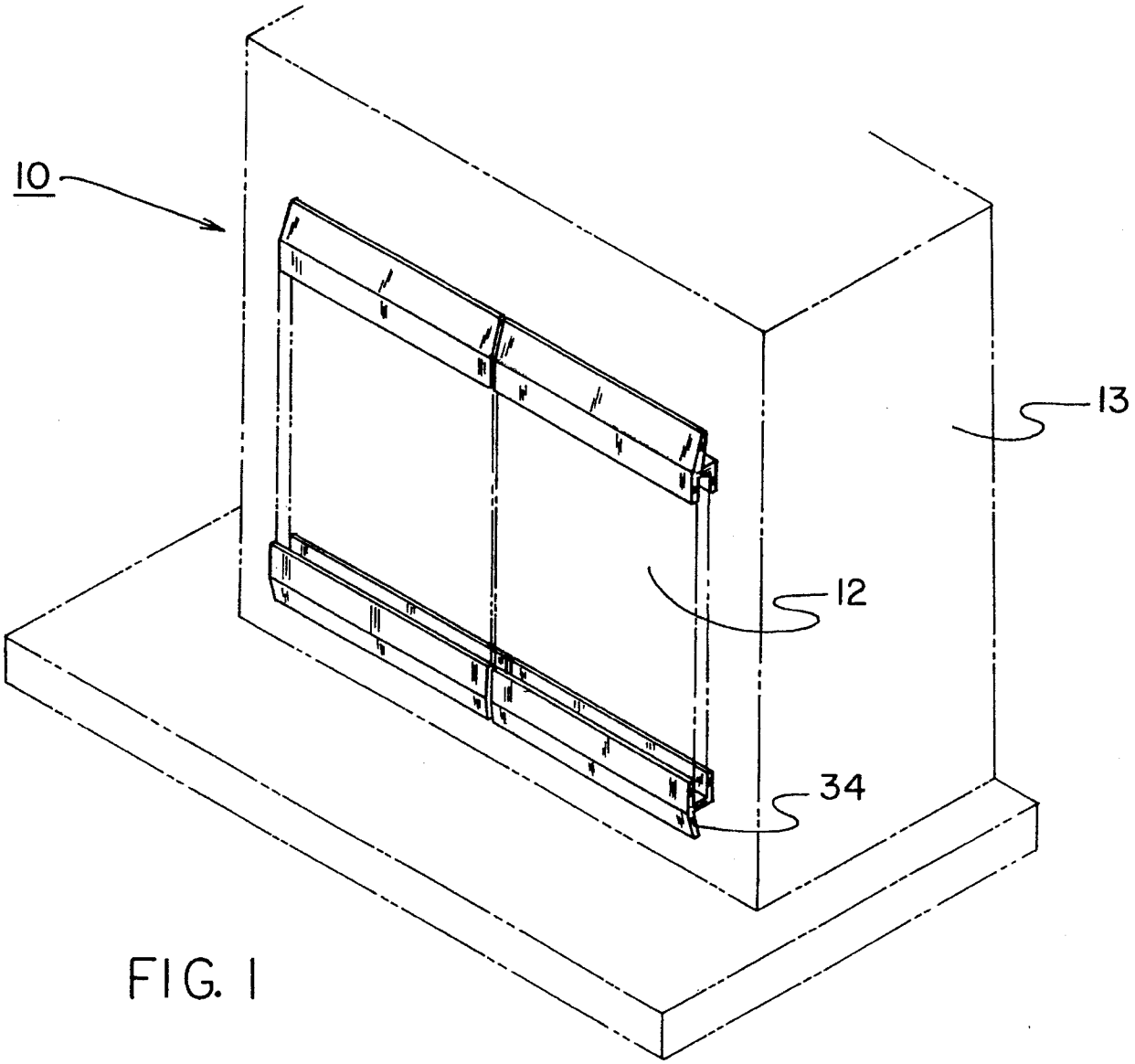
FIG. 1 is a perspective view of a preferred embodiment constructed in accordance with the principles of the present invention.

With reference now to the drawings, and in particular, to FIG. 1 thereof, the preferred embodiment of the new and improved fireplace weather stripping for use on fireplace doors embodying the principles and concepts of the present invention and generally designated by the reference number 10 will be described.

The preferred embodiment of the present invention essentially includes a strip 14. The strip is removably coupleable to a fireplace door 12 as shown in FIG. 1. Multiple strips in combination secured to the edges of fireplace doors on a fireplace help preclude warm air within an interior of a room from escaping from the room, through the fireplace 13, and upwards through an associated chimney. The present invention is configured to prevent loss of heat in a highly effective manner when secured to fireplace doors of a fireplace.

Figure 2:
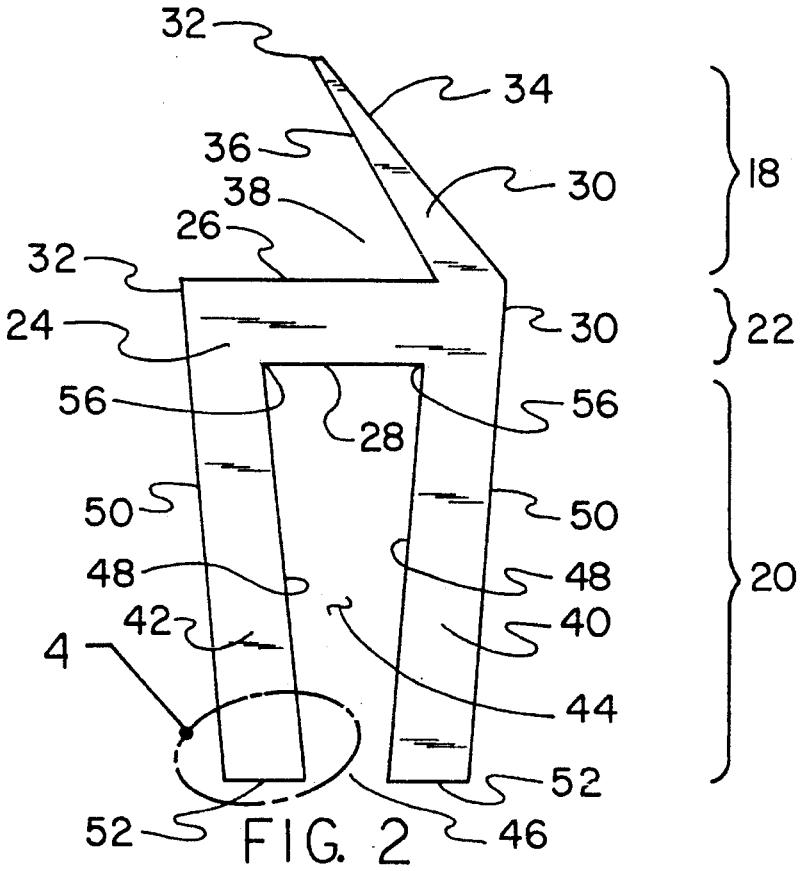
FIG. 2 is a cross-sectional view of the preferred embodiment of the present invention.
Figure 3:
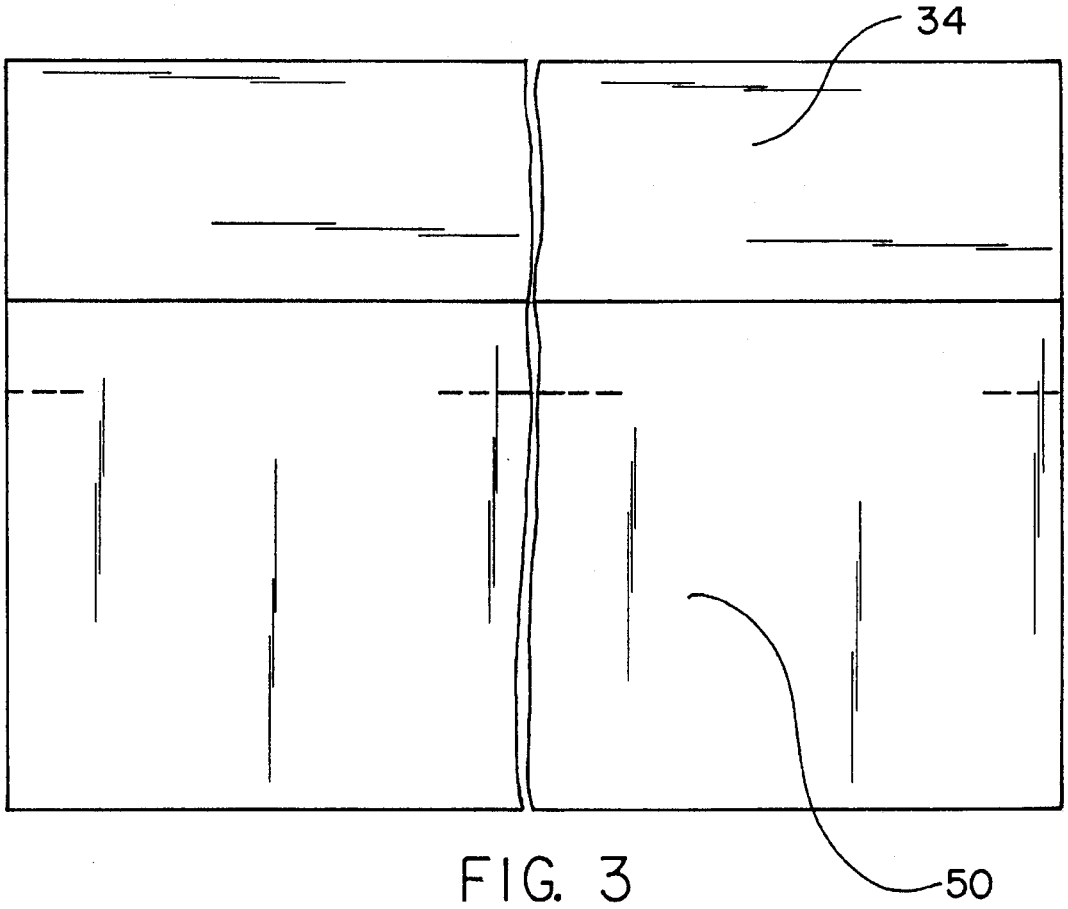
FIG. 3 is a side-elevational fragmentary view of the preferred embodiment of the present invention.

The strip 14 is elongated, straight, and flexible in structure. It is formed of a generally resilient steel material 16. The steel material 16 is coated with a layer of heat-resistant plastic. The plastic provides enhanced gripping abilities for allowing the strip to remain attached to glass fireplace doors without slipping. As best illustrated in FIG. 2, the strip includes an upper section 18, a lower section 20, and a central section 22 therebetween.

The central section 22 includes a body 24. The body has a central axis disposed therethrough, and a generally rectangular cross-section. This cross-section is formed of a horizontal planar upper surface 26, a horizontal planar lower surface 28, and a vertically oriented periphery interconnecting the upper and lower surfaces. The periphery is formed of a front edge 30, a rear edge 32, and a pair of opposed side edges 34. The body of the central section further has a characteristic thickness. This characteristic thickness is defined between the upper surface 26 and the lower surface 28 in a perpendicular fashion. In the preferred embodiment, this characteristic thickness is about 0.1 inches.

The upper section 18 includes an arm 30. The arm has a generally triangular cross-section. This cross-section is formed of an upper edge 32 positioned above the body 24 and aligned in a common vertical plane with the central axis of the body, a front planar surface 34 extended angularly upwards to the upper edge 32 from the upper surface 26 of the body at a location adjacent to the front edge 30 thereof, and a planar rear surface 36 extended angularly upwards to the upper edge 32 from the upper surface 26 of the body at a location offset from the front edge 30. This offset distance is essentially equal to the characteristic thickness of 0.1 inches. As shown in FIG. 2, the upper surface of the body 26 and the front surface 34 create an angle of about 60 degrees therebetween. The upper surface 26 of the body and the rear surface 36 of the arm create an angle 38 of between about 40–60 degrees therebetween. The arm has sufficient flexibility 30 that allows it to be bent, yet it retains sufficient rigidity that permits it to apply an opposing pressing force when so bent, such as when held against a fireplace 13. Thus, the arm is positionable against a fireplace 13 for blocking warm air from escaping through a gap formed between it and a fireplace. The upper section has a characteristic height essentially equal to three times the characteristic width. This characteristic height is defined between the top surface 26 of the body and a parallel plane containing the upper edge 32. In the preferred embodiment, the height of the upper section is 0.3 inches.

The lower section 20 includes a generally rectangular front leg 20 of a characteristic thickness. The front leg is integral with and extended angularly downwards from the lower surface 28 of the body near the front edge thereof. In addition, the lower section includes a generally rectangular rear leg 42. The rear leg has a characteristic thickness. The rear leg is also integral with and extended angularly downwards from the lower surface 28 of the body near the rear edge thereof. A holding space 44 is defined between the legs 40, 42. The holding space has an inverted trapezoidal cross-section. As best illustrated in FIG. 2, the holding space is symmetrically aligned with respect to the central axis of the body. The holding space has a sealed upper extent bounded by the lower surface 28. This sealed upper extent has a horizontal width that is about two times the characteristic thickness. Thus, in the preferred embodiment, this upper extent is 0.2 inches. The holding space has a lower opening 46 with a horizontal width that is essentially equal to the characteristic thickness.

Figure 4:
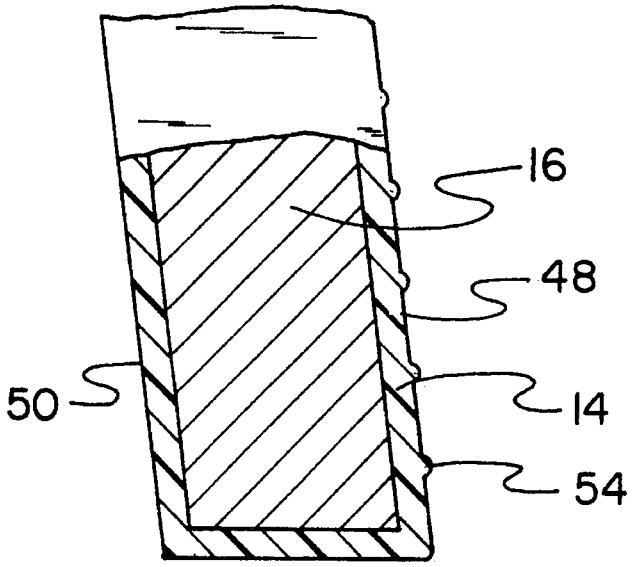
FIG. 4 is a fragmentary sectional view of the present invention as shown in FIG. 2.
Figure 5:
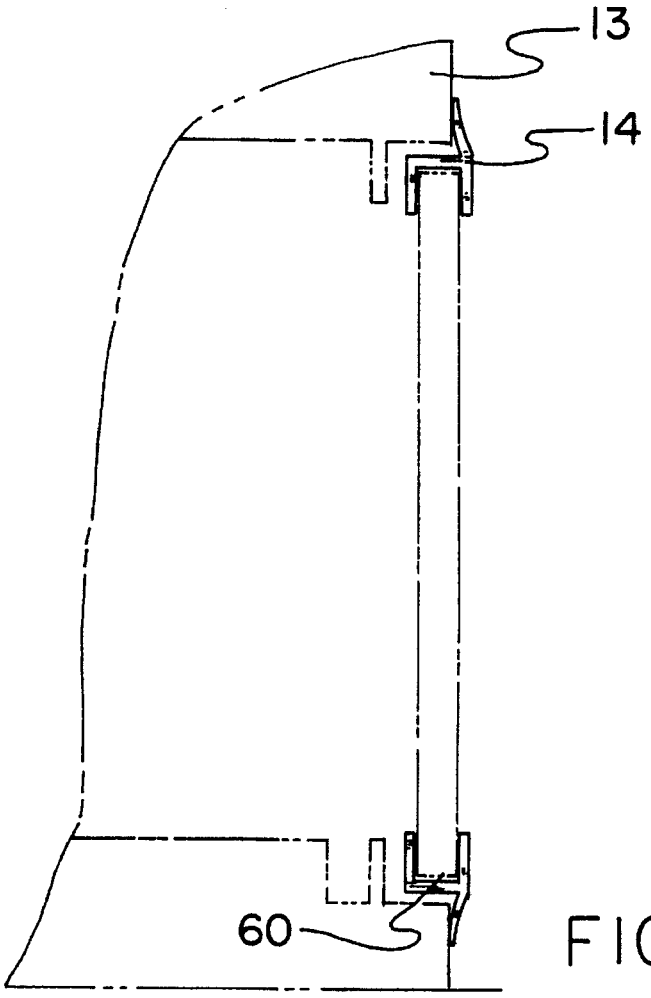
FIG. 5 is a side-elevational view of the present invention secured to a fireplace door.

As best illustrated in FIG. 4, the front leg 40 and rear leg 42 each have a planar inboard surface 48, a planar outboard surface 50, and a horizontal planar lower edge 52 interconnecting the inboard and outboard surfaces. In addition, a plurality of horizontally aligned and spaced ribs 54 can be formed on the inboard surface for increasing the gripping capability of the present invention. A pair of equally sized angles 56 are defined between the lower surface 28 of the body and the opposed inboard surfaces 48 of the legs. In the preferred embodiment, each of these angles is between about 4 to 5 degrees. The lower section has a characteristic height essentially equal to six times the characteristic thickness. Thus, in the preferred embodiment, this characteristic height is 0.6 inches. This height is defined between the lower surface 28 of the body and a common plane containing the lower edges 52 of the legs. The legs have sufficient flexibility that allows them to be pulled apart, yet they retain sufficient rigidity that permits them to apply an opposing clamping force when so pulled, such as when placed upon a fireplace door. An edge 60 of a fireplace door is removably secured within the holding space with the front leg 40 and the rear leg 42 on each side thereof applying a clamping force thereto. The arm 30 is placed in facing contact with a fireplace at a location adjacent to the fireplace door, thus covering a slot or gap formed between the fireplace door and the fireplace. Thus, the strip effectively blocks warm air from flowing through the slot and up the chimney of the fireplace. As shown in FIG. 1, a plurality of strips 14 are utilized to maximize the insulating effect.

The present invention is weather stripping for use on glass fireplace doors to help prevent warm air inside a home from escaping lap the associated chimney. The present invention is made of steel with a generally inverted U cross-section and has an upper section that is preferably bent at a 45 degree angle. The weather stripping could be available in different lengths to fit various styles of fireplace doors. The lower section includes two segments that are approximately 0.7 inches long and are bent together somewhat so that they form a tight grip when installed on the edge of a fireplace door. The entire strip is coated with a heat-resistant plastic to prevent marring the doors or the fireplace. The present invention is intended to be applied when the fireplace is not being used. The doors are opened and one strip is gently pressed on the top and bottom of each door, so that one segment of the "U" straddles the edge of the door. When the doors are closed, the angled upper section is placed in firm contact with the front of the fireplace to prevent heat from traveling up the chimney.

The present invention will not scratch the glass door nor mar the surface of the fireplace. It prevents excess heat loss through a chimney and because it is made of durable materials, it can be used year after year. Strips can be applied quickly and easily, and can be made in a variety of different colors to match any home setting.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A fireplace weather strip for use on a fireplace door comprising, in combination:

an elongated straight flexible strip formed of a generally resilient steel material coated with a layer of heat resistant plastic, the strip including an upper section, a lower section, and a central section therebetween, the central section including a body having a central axis disposed therethrough, a generally rectangular cross section formed of a horizontal planar upper surface, a horizontal planar lower surface, and a periphery interconnecting the upper and lower surfaces further formed of a front edge, a rear edge, a pair of opposed side edges, the central section further having a characteristic thickness of 0.1 inches as defined between the upper and the lower surfaces thereof, the upper section including an arm having a generally triangular cross-section formed of an upper edge positioned above the body and aligned in a common vertical plane with the central axis thereof, a front planar surface extended angularly upwards to the upper edge from the upper surface of the body at a location adjacent to the front edge thereof and with the upper surface of the body and the front surface creating an angle of about 60 degrees therebetween, and a rear planar surface extended angularly upwards to the upper edge from the upper surface of the body at a location offset from the front edge by a distance essentially equal to the characteristic thickness and with the upper surface of the body and the rear surface creating an angle of about 50 degrees therebetween, and wherein the upper section has a characteristic height essentially equal to three times the characteristic width as defined between the top surface of the body and a parallel plane containing the upper edge, and with the arm having sufficient flexibility for allowing it to be bent yet retaining sufficient rigidity for permitting it to apply an opposing pressing force when so bent, the lower section including a generally rectangular front leg of a characteristic thickness integral with and extended downwards from the lower surface of the body, a generally rectangular rear leg of a characteristic thickness integral with extended angularly downwards from the lower surface of the body, and a holding space with an inverted trapezoidal cross section therebetween wherein the holding space is symmetrically aligned with respect to the central axis and has a sealed upper extent with a horizontal width that is about two times the characteristic thickness and a lower opening with a horizontal width that is essentially equal to the characteristic thickness, the front and rear legs each having a planar inboard surface, a planar outboard surface positioned in parallel with the inboard surface, and a horizontal planar lower edge interconnecting the inboard and outboard surfaces and with a pair of equally-sized angles of between about 5 degrees defined between the lower surface of the body and the opposed inboard surfaces of the legs, wherein the lower section has a characteristic height essentially equal to six times the characteristic thickness as defined between the lower surface of the body and a common plane containing the lower edges of the legs, and with the legs having sufficient flexibility for allowing them to be pulled apart yet retaining sufficient rigidity for permitting them to apply an opposing clamping force when so pulled, and with an edge of a fireplace door removably securable within the holding space with the front and rear legs on each side thereof applying a clamping force thereto.

* * * * *